United States Patent [19]

Taylor

[11] Patent Number: 4,961,065

[45] Date of Patent: Oct. 2, 1990

[54] FAIL-SAFE RESISTOR

[75] Inventor: Eric B. Taylor, Willshire, Ohio

[73] Assignee: CTS Corporation, Elkhart, Ind.

[21] Appl. No.: 329,179

[22] Filed: Mar. 27, 1989

[51] Int. Cl.[5] ..... H01C 1/012

[52] U.S. Cl. ..... 338/308; 338/309

[58] Field of Search ..... 338/308, 309, 314, 307, 338/306; 337/160–163, 297; 361/125

[56] References Cited

U.S. PATENT DOCUMENTS

| | | | |
|---|---|---|---|
| 2,263,752 | 11/1941 | Babler | 361/125 X |
| 2,730,598 | 1/9156 | Lytle | 338/309 X |
| 3,836,883 | 9/1974 | Takayasu et al. | 337/163 |
| 3,978,443 | 8/1976 | Dennis et al. | 338/309 |
| 4,134,096 | 1/1979 | Denes | 338/308 X |
| 4,208,645 | 6/1980 | Harmon et al. | 337/297 |
| 4,263,574 | 4/1981 | Mori et al. | 337/161 |
| 4,315,235 | 2/1982 | Jacobs, Jr. | 337/161 |
| 4,494,104 | 1/9185 | Holmes | 337/403 |

*Primary Examiner*—George H. Miller, Jr.
*Assistant Examiner*—Marvin M. Lateef
*Attorney, Agent, or Firm*—Albert W. Watkins

[57] ABSTRACT

An electrical resistor is formed upon the substrate. The substrate is laser scribed, preformed, or notched in such a way as to control accurately the breakage of the substrate dependent upon the thermal stress load produced by the resistor. By varying the position of the scribe or notch, the device can be programmed to repeatably shatter at an infinite number of time-load points. The method for applying this technique is also described for other substates or configurations.

5 Claims, 5 Drawing Sheets

FAIL-SAFE RESISTOR

BACKGROUND OF THE INVENTION

1. Field of the Invention

This invention relates to fusible or fail-safe resistors generally, and specifically to controlled thermal destruction of the substrate upon which a resistor is carried.

2. Description of the Related Art

Prior art fusible or fail-safe resistors utilize several general techniques to produce an electrical and/or mechanical disconnection of power when the resistor is electrically overloaded. These techniques include the physical addition of a separate and distinct fuse directly adjacent to the resistor, the combination of a fuse link or fuse element adjacent with or integral to the resistor, the use of a thermally sensitive substrate or device which when thermally stressed produces some expansion resultant in the disconnection of power to the resistor, or the use of a controlled resistance film thickness which when overloaded evaporates.

Prior art devices which utilize a separate and distinct fuse element are inherently costly since two devices need to be placed rather than one, resulting in a higher cost of materials, higher cost of production, lower end product reliability, and increased component space consumption.

Those devices which employ a fuse or fuse link integral to the resistor also face similar cost problems. Again, the fuse or fuse link requires extra materials and processing steps which are primarily exclusive to the fuse. The major advantage gained in this type of system is the reduced real estate required for the fuse link. Additional advantage may be gained in the sensitivity of the fuse to the thermal status of the resistor due to the close proximity of the fuse. A fuse of this type is illustrated in U.S. Pat. No. 4,494,104 to Holmes. Illustrated is a gold/solder fuse link spanning a gap between two resistor bodies, all on a common substrate. The fuse link is sensitive to the temperature of the common substrate, and breaks connection when this substrate reaches a sufficient temperature.

Another type of fusible resistor is a controlled film thickness resistor. This type of resistor may be either vapor deposited or screen printed or produced by any of a variety of other known techniques, but it is always produced so as to have a controlled cross-section through which the current must flow. This controlled cross-section of resistance material then vaporizes upon excessive heating. This type of resistor is difficult and expensive to manufacture and usually has poor reliability characteristics. In order to overcome the variables in typical discrete fuses, which operate on a similar principle, the discrete fuses are glass encapsulated. Such encapsulation would clearly increase the cost substantially for a typical resistor.

Additional complex devices are known in the art which include bimetallic strips or other types of thermally sensitive mechanical devices to control the application of electrical energy to the device, such as are illustrated in U.S. Pat. Nos. 3,763,454 to Zandonatti and 2,263,752 to Babler, but do to the complexity, these devices are also inherently expensive and raise reliability concerns.

Additional devices which employ thermally responsive substrates are disclosed in the prior art. Such devices include substrates which shatter upon excessive heating, such as disclosed by Lytle in U.S. Pat. No. 2,730,598. Another variation is disclosed by Harmon et al in U.S. Pat. No. 4,208,645 in which a substrate material is disclosed which expand along a single axis differently from the other two axes, sufficiently so that a circuit trace connecting the resistance material to the source of electrical energy may be separated.

Dennis et al in U.S. Pat. No. 3,978,443 disclose a resistor having long conductors which cross a path on a porcelain substrate which is identified as being the most likely region of substrate failure. The substrate then breaks along a .scribed mark positioned to correspond to this most likely region upon overheating of the resistance material and substrate. This method represents the most reproducible of the prior art methods for causing a resistor to fail at a controlled energy dissipation point, but still suffers from several drawbacks. First, the scribe must either be placed entirely across the device, or in the alternative embodiment, must pass entirely through a portion of the substrate, in each case in a zone predetermined to be the most likely for thermal device failure. If the scribe passes across the entire surface of the substrate, then the resistance material must be coated directly on top of the scribe, resulting in a much more difficult and less reliable resistor. If the scribe passes through the device, it requires custom molded substrates (higher cost) and does not result in particularly controllable results.

OBJECTS OF THE INVENTION

The present invention seeks to overcome the above described limitation by providing a method for interruption of an electric circuit in a controllable and low cost way.

The present invention additionally has as an object the utilization of low cost materials which are readily available from numerous sources to provide both low cost and flexibility of design.

The present invention additionally has as an object the utilization of a design which optimizes reliability.

SUMMARY OF THE INVENTION

The present invention utilizes a substrate upon which has been deposited a resistance material. The substrate is laser scribed, preformed, or notched in such a way as to control accurately the breakage of the substrate dependent upon the thermal stress load produced by the resistor. By varying the position of the scribe or notch, the device can be programmed to repeatably shatter at an infinite number of time-load points.

DESCRIPTION OF THE PREFERRED EMBODIMENT

Figure 1:
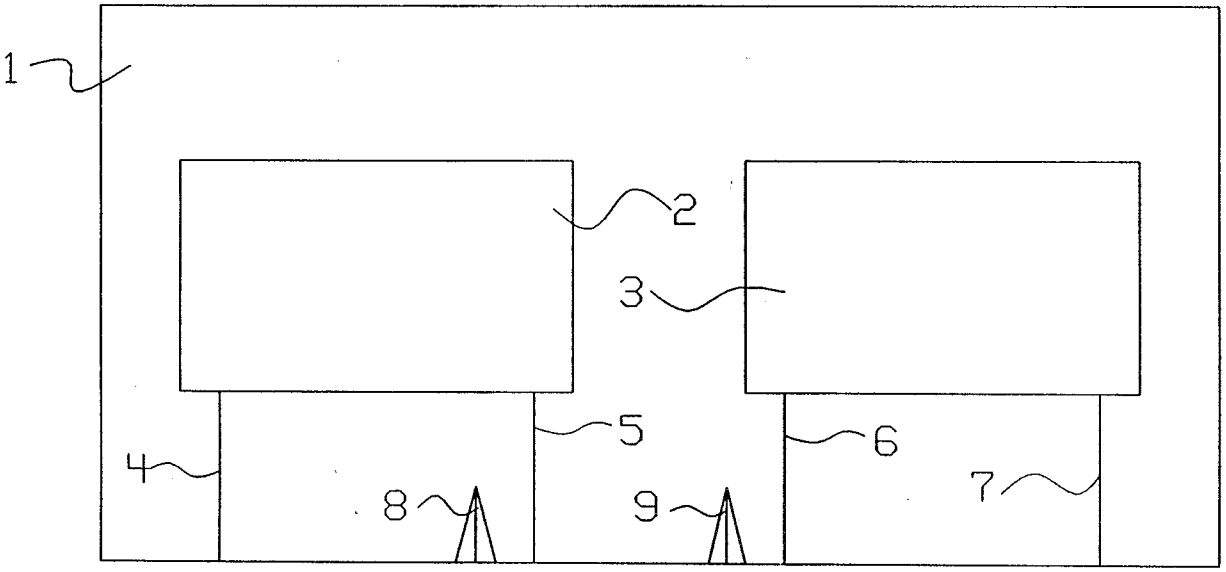
FIG. 1 shows a top view of the batterY feed resistor of the preferred embodiment utilizing molded notches.
Figure 2:
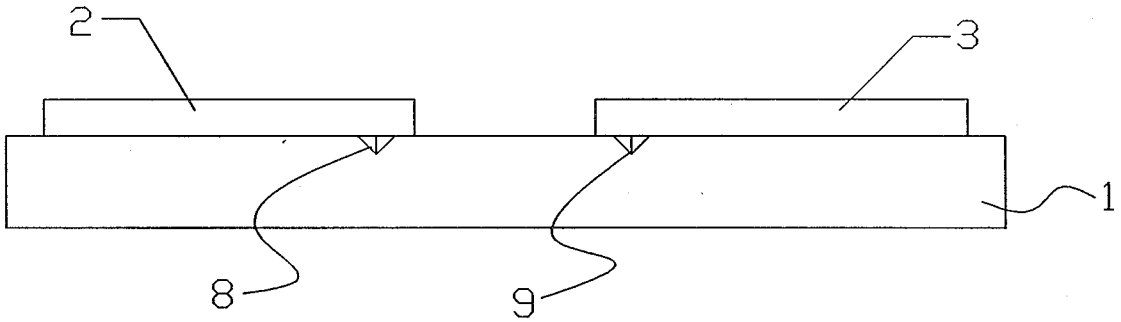
FIG. 2 shows a side view of the battery feed resistor of FIG. 1.

The preferred embodiment of the present invention is shown beginning in FIG. 1 by top view and FIG. 2 by side view. The battery feed resistor substrate 1 has deposited onto it resistance elements 2 and 3. These may be deposited by one of a variety of techniques including, but not limited to, vapor deposition, screen printing, and bonding. The requirements for deposition are that resistance elements 2 and 3 be attached both thermally and mechanically to the substrate. The substrate 1 is preferred to be formed from a ceramic such as alumina, but can be fashioned from any variety of materials which will thermally stress to the point of failure when designed according to the remainder of this disclosure. Materials contemplated include ceramics, porcelains, glasses, and other frangible materials. Conductors 4–7 are illustrated as providing electrical connection from the edge of the substrate to the resistance elements 2 and 3. Along the edge of the substrate may be provided pins (not illustrated) or some type of edge card connector or ZIF socket or contact probe. Additionally illustrated are molded notches 8 and 9. These notches and corresponding visible elements are shown by side view in FIG. 2. The notches 8 and 9 are illustrated in a particular geometric position relative to the resistance elements 2 and 3. However, by positioning the notches in different locations around the periphery of battery feed substrate 1, the temperature at which the substrate fails may be controlled to correspond with the user's requirements. This will be described in more detail in reference to FIG. 5. It is sufficient for now to note that the position of notches 8 and 9 is not fixed by anything other than a choice by the designer of the optimum positioning required to produce a failed substrate at a given time-energy load point. Notches 8 and 9 are illustrated as being of inverse tetrahedron shape. This shape has been the preferred shape of the present invention, but other suitable shapes which perform similar weakening of the substrate locally at the point or termination of the notch would be equally as effective in producing the desired controllable fracturing of the substrate.

Figure 3:
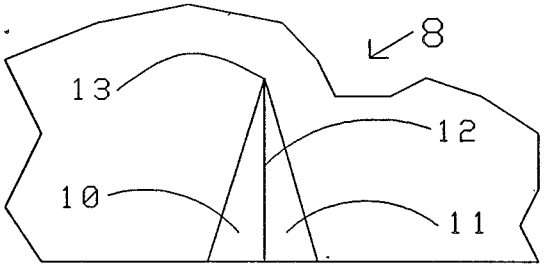
FIG. 3 shows an enlarged view of a proposed molded notch.

The molded notch is illustrated in greater detail in FIG. 3. The notch has two relatively triangular planar faces 10 and 11 which adjoin at trough line 12. Faces 10 and 11 and trough line 12 merge at point 13. Point 13 is the primary tensile stress concentrating point. It is the location of point 13 which is the primary controlling factor in determining the breakage or failure characteristics of the substrate. Of secondary concern are the depth of the notch, shape of the notch, and the thickness of the substrate. The present invention contemplates the idea that most of the stresses are concentrated along the surface of the substrate where the resistive elements are deposited. For other configurations, this contemplation may not be accurate. Such variations in configurations are believed to be readily determinable by one of ordinary knowledge in this field with the insight provided by the herein described preferred embodiment.

Figure 6:
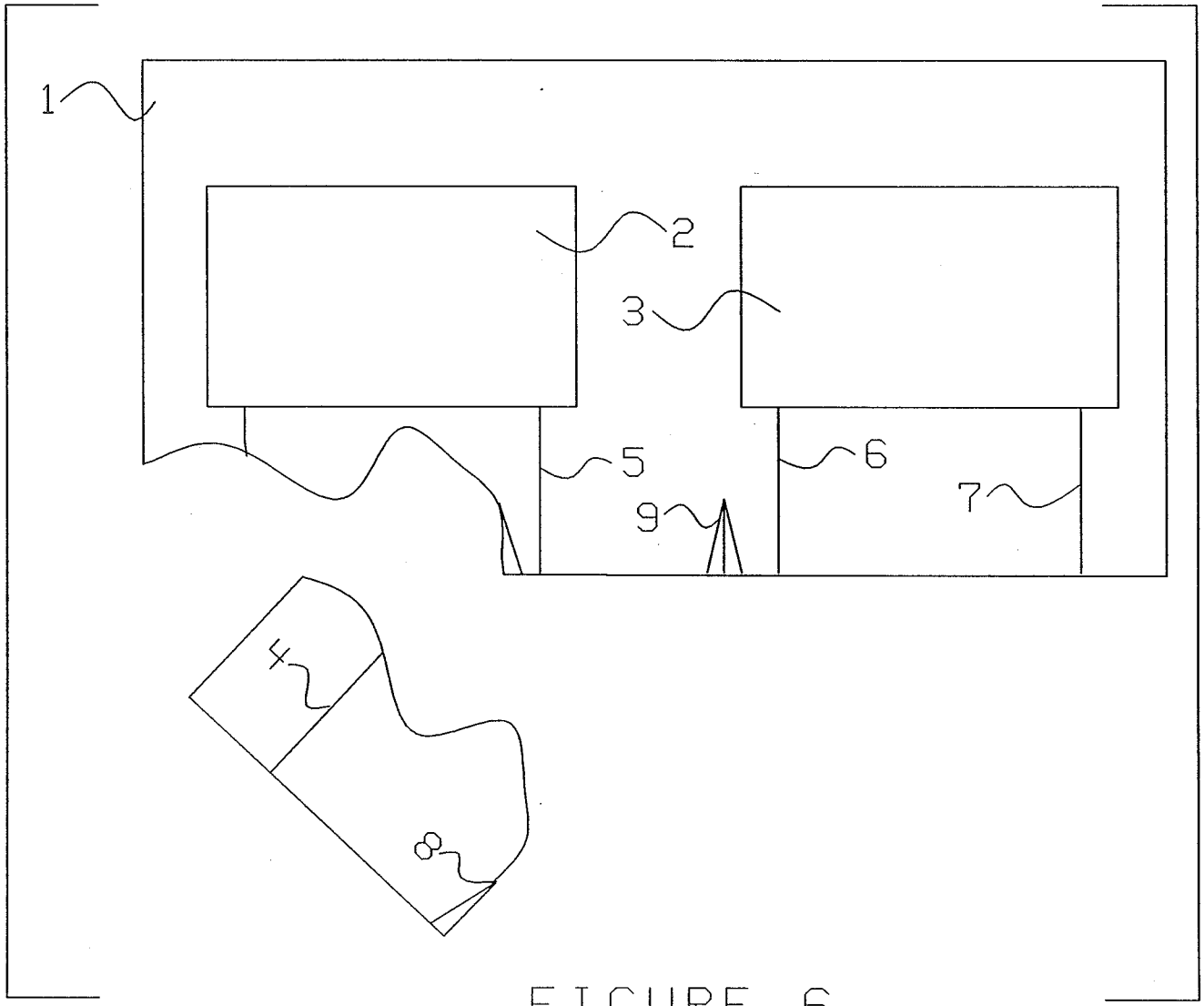
FIG. 6 shows a top view of the preferred embodiment after breakage.

FIG. 6 illustrates one exemplary substrate which has broken in accord with the present invention.

Figure 5:
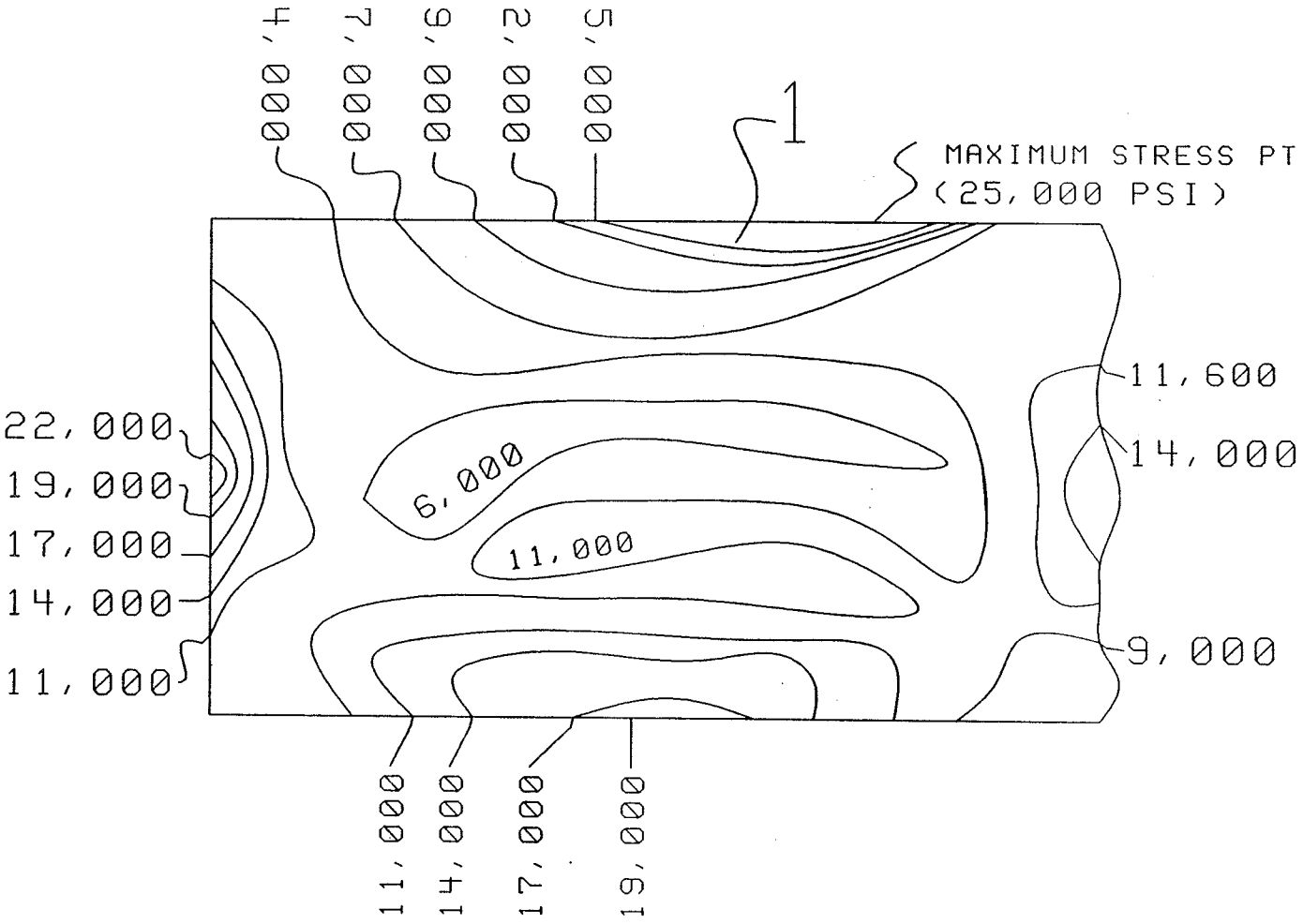
FIG. 5 shows a stress plot taken from the top view of one half of the substrate of FIG. 1.

FIG. 5 is a substrate stress plot taken from the same view direction as FIG. 1 which details the internal stresses of greatest interest in this particular embodiment, for a single resistive element 2 and only one half of substrate 1 illustrated. Shown in FIG. 5 are numerous lines of equal stress in battery feed substrate 1. Most of the tensile stress is concentrated in the external regions of the substrate, as these regions are not equally offset by internal expansive compressive stresses resulting from the heating effect of resistive elements 2 and 3. It is therefore significant to note that the greatest control over the points at which breakage occurs can be gained by placing point 13 at various locations around the periphery of substrate 1. This placement allows very precise and repeatable control over the time energy characteristics of the substrate breakage.

With the control over the breakage point described herein, a special advantage over other prior art references is realized. The prior art references which utilized the breakage of the substrate as the means for device failure required testing of the device to determine the most likely failure zone or mode. From the stress plot, a desirable shape and position of a molded notch is readily determinable for a given application.

Figure 4:
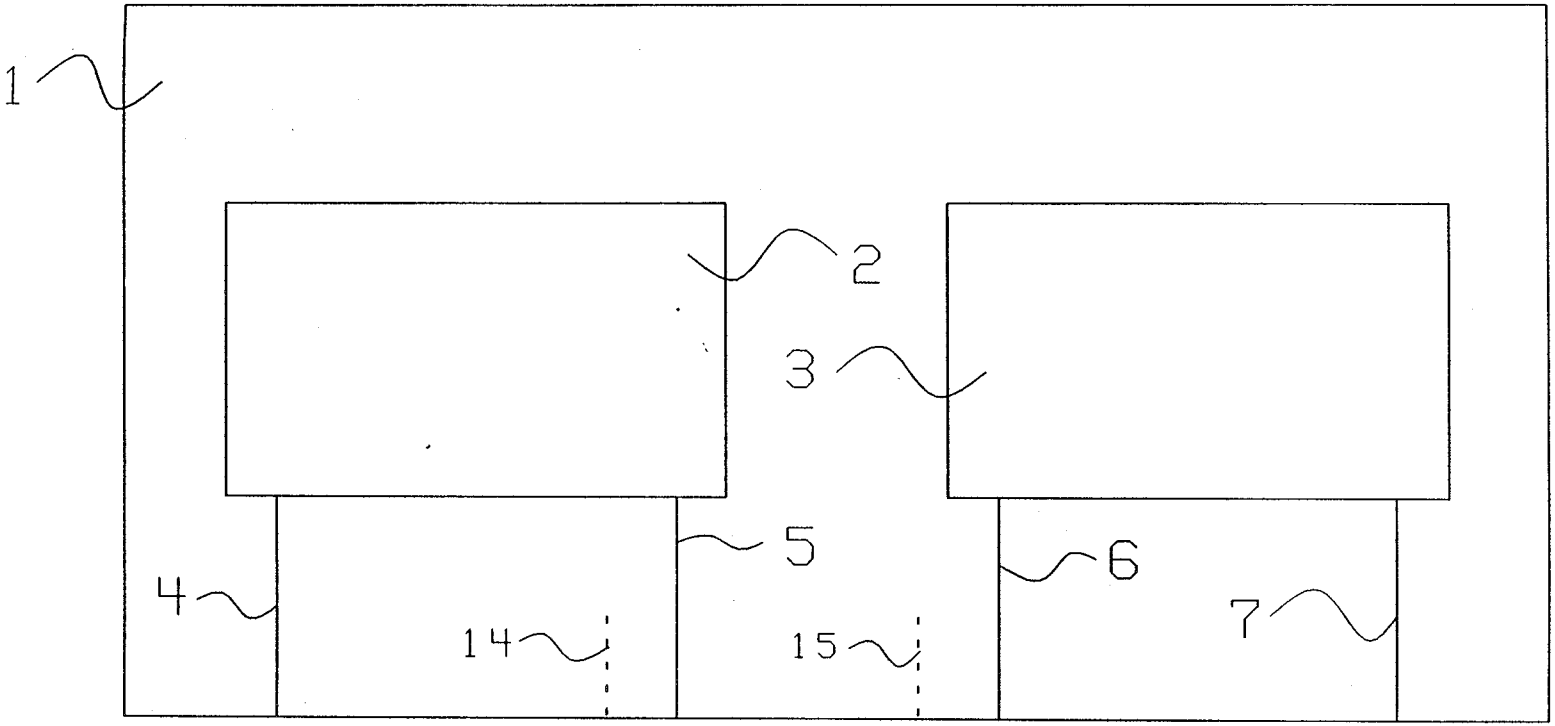
FIG. 4 shows a top view of an alternative embodiment utilizing a laser scribe mark.

FIG. 4 illustrates an alternative embodiment of the present invention, from a top view. Corresponding elements are designated with corresponding numbers to save repetition and avoid confusion. Substrate 1, resistive elements 2 and 3, and conductive leads 4–7 are essentially identical to those described in reference to FIGS. 1 and 2. Illustrated in FIG. 4 are two laser scribe marks 14 and 15 which serve in the same capacity as notches 8 and 9 of the preferred embodiment. It is significant to note that the laser scribe marks are not required to penetrate the substrate but merely affect the highly stressed surface when the device is under severe thermal load. The same design concepts apply regardless of the embodiment of the invention. The laser scribe (or other suitable methods well-known in the field) serve a similar purpose in concentrating the tensile stress to a localized region to precipitate failure of the device at a predetermined load-time point.

A special advantage of this design over prior art designs is the need for only a relatively limited (albeit well placed) flaw upon which no resistive or conductive must be placed. This provides for improved yields of the manufactured product, at reduced cost per part.

The embodiments disclosed hereinabove are in no way intended to limit the scope of the invention, but are provided merely as a mode of illustrating the concepts involved in the utilization of the invention. While the foregoing description details what is felt to be the preferred embodiment of the invention, no material limitations to the scope of the claimed invention is intended. Further, features and design alternatives which would be obvious to one of ordinary skill in the art are considered to be incorporated herein. The scope of the invention is set forth and particularly described in the claims hereinbelow.

I claim:

1. A fail-safe resistor comprising:

a relatively electrically non-conductive frangible substrate;

a means for conducting electricity, said conducting means being thermally coupled to said substrate;

a flaw within or upon said substrate, said flaw having one of multiple possible predetermined controlled dimension and multiple possible predetermined position combinations relative to said substrate;

whereby a predictable time duration for a particular power dissipation in said conducting means is required and sufficient to cause a break in said frangible substrate and to cause electrical discontinuity of said conducting means, said time duration dependent upon which one of said multiple controlled dimension and position combinations is further combined with said particular power dissipation.

2. The fail-safe resistor of claim 1 wherein said substrate is comprised by a material which is relatively strong in compressive strength and which is relatively weak in tensile strength.

3. The fail-safe resistor of claim 2 wherein said flaw is dimensioned and positioned at the exterior perimeter of said substrate, said flaw extending a relatively small distance towards an interior region of said substrate.

4. A fail-safe resistor comprising a relatively electrically non-conductive fracturable substrate, a relatively electrically conductive material thermally and physically coupled to said substrate, and a means for regulating the amount and duration of thermal energy required to fracture said substrate and simultaneously fracture said relatively electrically conductive material, said amount and duration of said thermal energy required governed and variable by alteration of a predetermined position of said regulating means relative to said substrate.

5. The fail-safe resistor of claim 4 wherein said means for regulating the amount and duration of thermal energy required is not in physical or electrical contact with said electrical conductor.

* * * * *